US006883879B2

(12) United States Patent
Latchinian

(10) Patent No.: US 6,883,879 B2
(45) Date of Patent: Apr. 26, 2005

(54) DISPLAY CASE ASSEMBLY SYSTEM

(76) Inventor: Jim S. Latchinian, 6745 Ixora Dr., Miramar, FL (US) 33023-4860

( * ) Notice: Subject to any disclaimer, the term of this patent is extended or adjusted under 35 U.S.C. 154(b) by 0 days.

(21) Appl. No.: 10/277,244

(22) Filed: Oct. 22, 2002

(65) Prior Publication Data

US 2004/0075371 A1 Apr. 22, 2004

(51) Int. Cl.[7] ..... A47B 47/00

(52) U.S. Cl. ..... 312/140; 312/223.5; 312/223.6; 312/265.4

(58) Field of Search ..... 312/140.1, 265.1, 312/265.2, 265.3, 265.4, 140, 114, 138.1, 223.5, 223.6

(56) References Cited

U.S. PATENT DOCUMENTS 2,825,615 A * 3/1958 Zimmerla ..... 312/140
3,228,736 A * 1/1966 Beckerman ..... 312/140
3,973,371 A * 8/1976 Heller ..... 312/257.1
4,768,845 A * 9/1988 Yeh ..... 312/257.1
5,503,471 A * 4/1996 Aspenwall ..... 312/140
6,419,331 B2 * 7/2002 Wei ..... 312/265.1

* cited by examiner

*Primary Examiner*—Janet M. Wilkens
(74) *Attorney, Agent, or Firm*—Oltman, Flynn & Kubler

(57) ABSTRACT

A display case assembly system includes several closed frame tubes, each closed frame tube including two closed frame tube longitudinal ends, at least one closed frame tube longitudinal end including a fastener receiving structure; several laterally breakable frame tubes, each breakable frame tube including a breakable frame tube mounting section having a fastener port; at least one fastener fitted through the fastener port in one of the mounting section and into one of the fastener receiving structures in one of the closed frame tube longitudinal ends, so that at least one breakable frame tube is fastened to one closed frame tube longitudinal end; a breakable frame tube cover section with snap engagement structures for snap engagement with the mounting section to form a composite tube concealing the at least one fastener; and a panel mounted and extending between the closed frame tube and the breakable frame tube.

19 Claims, 15 Drawing Sheets

210
212
214
216
220
222
224
32
34

210
212
214
220
222
224
32
34

DISPLAY CASE ASSEMBLY SYSTEM

BACKGROUND OF THE INVENTION

1. Field of the Invention

The present invention relates generally to the field of product retaining structures for containing and displaying products in stores. More specifically the present invention relates to a display case assembly system which is rapidly and easily assembled with conventional threaded fasteners rather than with traditional display case frame connectors, which entirely conceals the fasteners and any lighting fixture electric wiring, and which produces a display case with a neatly finished appearance, thereby solving long term industry problems with elegant simplicity.

The system includes several extruded closed frame tubes and several extruded laterally breakable frame tubes, which interconnect to form a display case frame and between which opaque and transparent panels are fitted and retained, the breakable frame tubes each including a mounting section through which fasteners are passed into longitudinal ends of perpendicular closed frame tubes and a cover section which snap fits and engages laterally to the mounting section to form a composite tube concealing the fasteners and any fixture wiring. A panel engaging profile slat is secured to a longitudinal mounting face of each closed and breakable frame tubes and has the dual function of mounting and retaining a display case panel and of extending across and blocking longitudinal sliding movement of breakable frame tube cover sections relative to their mounting sections, the longitudinal slat mounting face of each closed frame tube preferably being provided with a profile slat engaging structure in the form of longitudinal tongue elements which slide engagingly into longitudinal groove elements on a face of each profile slat.

Where a display case lighting fixture is provided, wiring is fitted longitudinally through a closed frame tube, and through a wiring port in a breakable frame tube mounting section, and along the mounting section either to enter another closed frame tube or to exit the case frame through a flexible hose. Then a cover section is snap engaged onto the mounting section.

2. Description of the Prior Art

There have long been display cases for jewelry and other store items formed of opaque and transparent panels joined together at various orientations to define closed containers. The methods of forming closed containers have included: molding, in which relatively small items of various shapes can be produced in large quantities such as by injection molding; stamping and bending, in which face material is bent onto itself to form edges, such as by bending sheet metal to construct office furniture; panel processing, in which edges of face panels are joined together by means of dowels, screws, staples or connectors (minifix, rafix or alike) or are simply glued together, such as to manufacture conventional furniture or display cases; and structural edge assembly in which rigid frame structures, typically formed of metal, are joined together to create a desired self-supporting shape into which face panels are inserted to fill gaps between frame members and produce a final closed structure. Since display cases typically must be adaptable and changeable to any of various shapes, must be capable of incorporating any of various selected face materials and incorporating wiring systems for lights and should be economical to produce in small production runs, the structural edge assembly method is best suited.

A problem with prior structural edge assembly methods has been that frame connectors have been used to connect hollow, tubular frame members, often producing sloppy frame member joints and preventing or making difficult concealed passage of electrical wiring through the hollow frame members, and that frame assembly has been very time consuming and awkward. The alternative to frame connectors has been ordinary screw fasteners fitted through frame members with the fastener heads exposed, producing an unattractive and unfinished appearance.

It is thus an object of the present invention to provide a display case assembly system which can produce display cases of an infinite variety of shapes and sizes, which assembles into display cases quickly and easily, and without use of traditional display case frame connectors and with seamless joints, which can include a wide variety of decorative surfaces or panels such as glass, mirror, wood veneers, laminates, acrylics, and sheet metal, and can include various decorative crown and base moldings and has built-in, integral lamp fixtures able to receive linear and PL-13 fluorescent lamps as well as halogen bi-pin G4 bulbs.

It is another object of the present invention to provide such a display case assembly system which is fastened with ordinary screws and which conceals all fasteners and all fixture wiring with snap engagement display case frame elements, which permits the end product display case to be shipped partially or complete disassembled and ready to put together with a single hand screwdriver, with little or no skill.

It is yet another object of the present invention to provide such a display case assembly system which produces a display case which is aesthetic in its balanced proportions, requires no quality control and which is efficient in its production, for which only half of the wall panels have to go through a secondary manufacturing process after the initial cut.

It is still another object of the present invention to provide such a display case assembly system in which all display case wall panels are discrete and independent of each other, being interconnected by display case frame members, and which requires fewer display case frame members than many other systems.

It is yet another object of the present invention to provide such a display case assembly system for which there is no fixed order of assembly, so that the assembly process can start at virtually any assembly step and progress efficiently to completion. In other words, all panels and case frame elements are totally independent from each other in the final assembly of the product, so that each single panel or case frame element can be removed and replaced without interference with any of the other system elements.

It is finally an object of the present invention to provide such a display case assembly system which produces a display case which is extremely reliable, strong and rigid and which is comparatively inexpensive to manufacture and which saves substantial costs in assembly labor.

SUMMARY OF THE INVENTION

The present invention accomplishes the above-stated objectives, as well as others, as may be determined by a fair reading and interpretation of the entire specification.

A display case assembly system is provided, including several closed frame tubes, each closed frame tube including two closed frame tube longitudinal ends, at least one closed frame tube longitudinal end including a fastener receiving structure; several laterally breakable frame tubes, each breakable frame tube including a breakable frame tube mounting section having a fastener port; at least one fastener fitted through the fastener port in one of the mounting section and into one of the fastener receiving structures in one of the closed frame tube longitudinal ends, so that at least one breakable frame tube is fastened to one closed frame tube longitudinal end; a breakable frame tube cover section with snap engagement structures for snap engagement with the mounting section to form a composite tube concealing the at least one fastener; and a panel mounted and extending between the closed frame tube and the breakable frame tube.

The panel is one of an opaque panel and a translucent panel. Each closed frame tube preferably has a longitudinal slat mounting face, additionally including a panel engaging profile slat secured to one longitudinal slat mounting face for mounting and retaining a display case panel and for extending across and blocking longitudinal sliding movement of an adjacent cover section relative to an adjacent the mounting section.

The longitudinal slat mounting face of the closed frame tube preferably includes a profile slat engaging structure. The profile slat engaging structure preferably includes a longitudinal tongue element and the profile slat preferably includes a longitudinal groove element sized so that the longitudinal tongue element slides engagingly into the longitudinal groove element. The display case assembly system preferably additionally includes a wiring port in at least one mounting section and additionally including a display case lighting fixture and lighting fixture wiring fitted longitudinally through the closed frame tube and through a wiring port in the breakable frame tube mounting section. The wiring port preferably is fitted and lined with a wire passing grommet.

Each closed frame tube preferably includes a tube of one of: substantially square cross-section and substantially rectangular cross-section and having a tube slat engaging wall, a tube panel engaging wall, and first and second tube side walls. Several of the closed frame tubes optionally are formed of extruded aluminum. The slat engaging wall preferably has an inward face and a channel-shaped fastener engaging bead preferably extends longitudinally along the inward face of the tube slat engaging wall and along the inward face of the tube panel engaging wall, the channel-shaped fastener receiving bead being tapped at each end for receiving at each end a threaded fastener passing through the breakable frame tube mounting section and connecting the breakable frame tube to the closed frame tube. The outward face of the tube slat engaging wall preferably includes the profile slat engaging structure. The tube panel engaging wall preferably includes an inward jog defining a panel receiving channel.

The mounting sections preferably each include two mounting walls having intersecting and integral mounting wall connected edges, each mounting wall having a cover wall free edge shaped to form a mounting section snap engagement structure. The cover sections preferably each include two cover walls having intersecting and integral cover wall connected edges, each cover wall having a cover wall free edge shaped to form a cover section snap engagement structure configured to snap engage one of the mounting section snap engagement structures, so that the cover section can be snapped engagingly to the mounting section. The display case assembly system preferably additionally includes a wiring port adjacent to each mounting wall longitudinal end. The display case assembly system preferably additionally includes a fastener passing port adjacent to each mounting wall longitudinal end and being positioned to correspond and register with an open end of one of the fastener receiving beads of one of the closed frame tubes.

The display case assembly system optionally additionally including a hinged door panel, the hinged door panel including a panel mounting channel with a hinge secured longitudinally along the panel mounting channel, and the hinge being connected longitudinally to the first tube side wall of a closed frame tube so that the panel mounting channel pivots on the hinge relative to the closed frame tube; and a panel fitted into the panel mounting channel. The panel has a panel perimeter and preferably additionally including additional lengths of panel mounting channel fitted around the panel perimeter to define a panel frame.

The closed frame tube optionally additionally includes a downwardly arched reflector plate protruding outwardly from the tube second side wall adjacent to the slat engaging wall; a fixture slat receiving gap between the second tube side wall and the tube panel engaging wall, the second tube side wall and the tube panel engaging wall having opposing fixture slat engaging structures; and a fixture slat with a first fixture slat face and a lighting fixture mounted to the first fixture slat face and engaged by the fixture slat engaging structure, extending across the fixture receiving gap and oriented so that the lighting fixture protrudes underneath the reflector plate. The lighting fixture preferably is a fluorescent bulb fixture.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
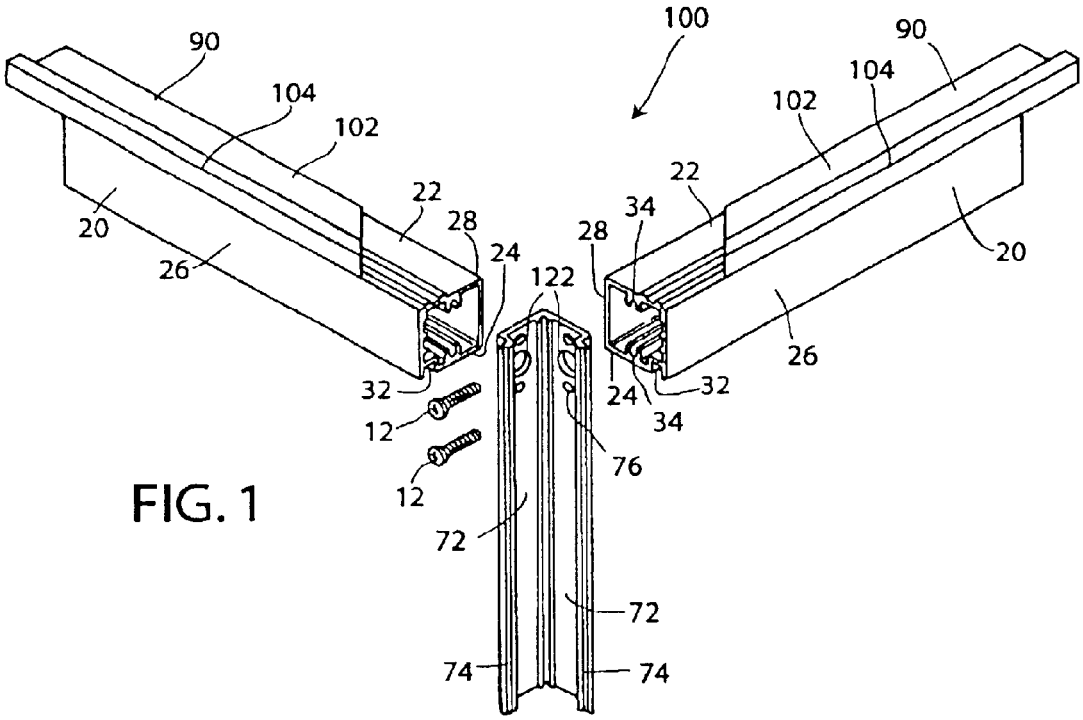
FIG. 1 is a perspective view of the inventive display case frame showing two co-planar closed frame tubes fitted with panel engaging profile slats and positioned for fastening to a the mounting section of a breakable frame tube.
Figure 2:
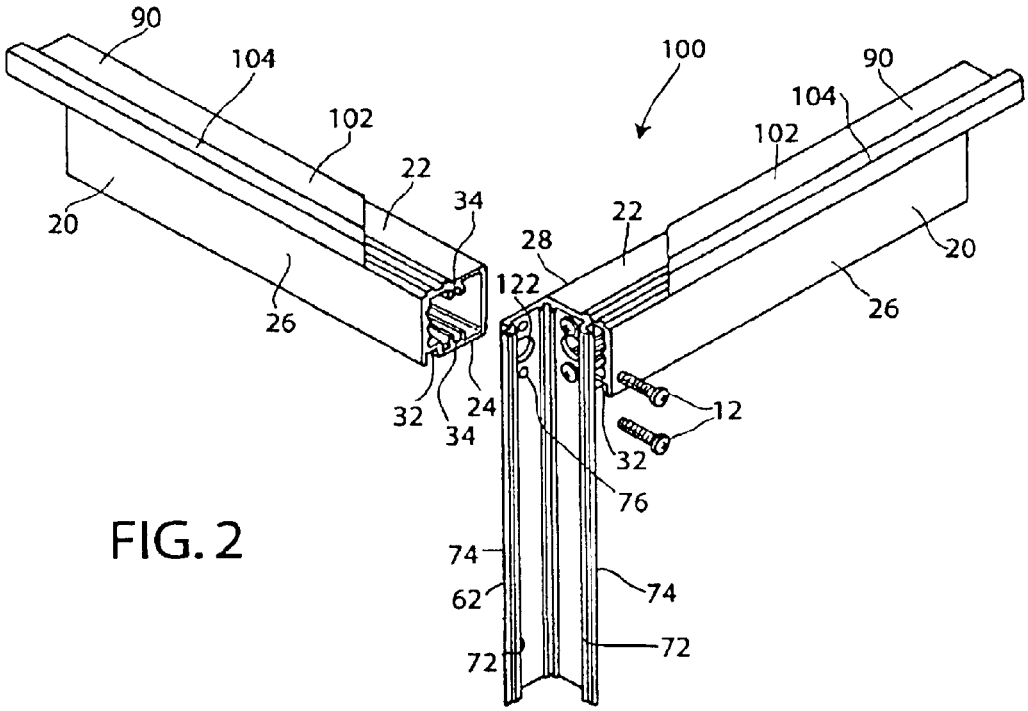
FIG. 2 is a view as in FIG. 1, with one of the closed frame tubes fastened into place against the upper end of the breakable frame tube mounting section.
Figure 3:
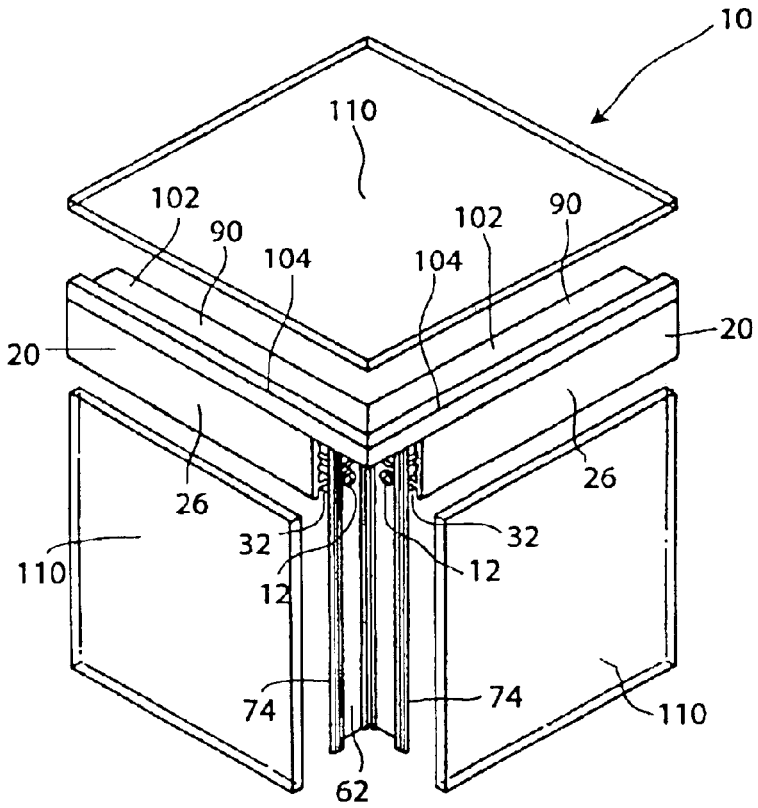
FIG. 3 is a view as in FIGS. 1 and 2 with both closed frame tubes fastened to the mounting section and two side and one top panel positioned for fitting into panel receiving channels and slat engaging channels.
Figure 4:
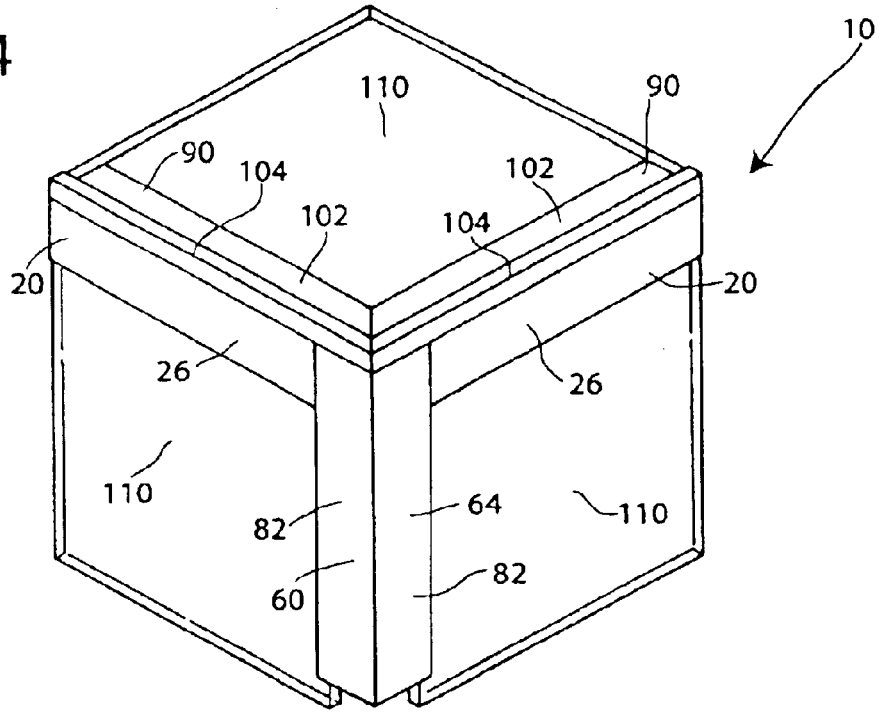
FIG. 4 is a view as in FIG. 3 with the panels fitted into place so that a display case portion or an entire display case is defined.
Figure 5:
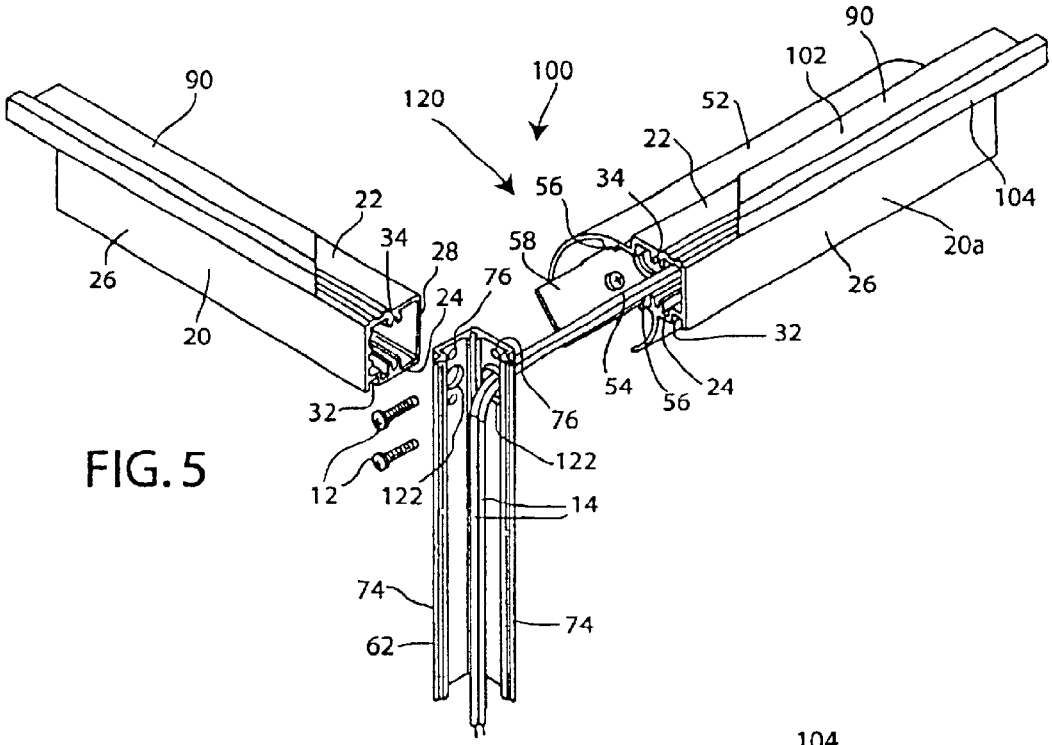
FIGS. 5 and 6 are views as in FIGS. 1 and 2, but with a basic closed frame tube replaced with a lighting fixture mounting closed frame tube and lighting fixture wiring included.
Figure 6:
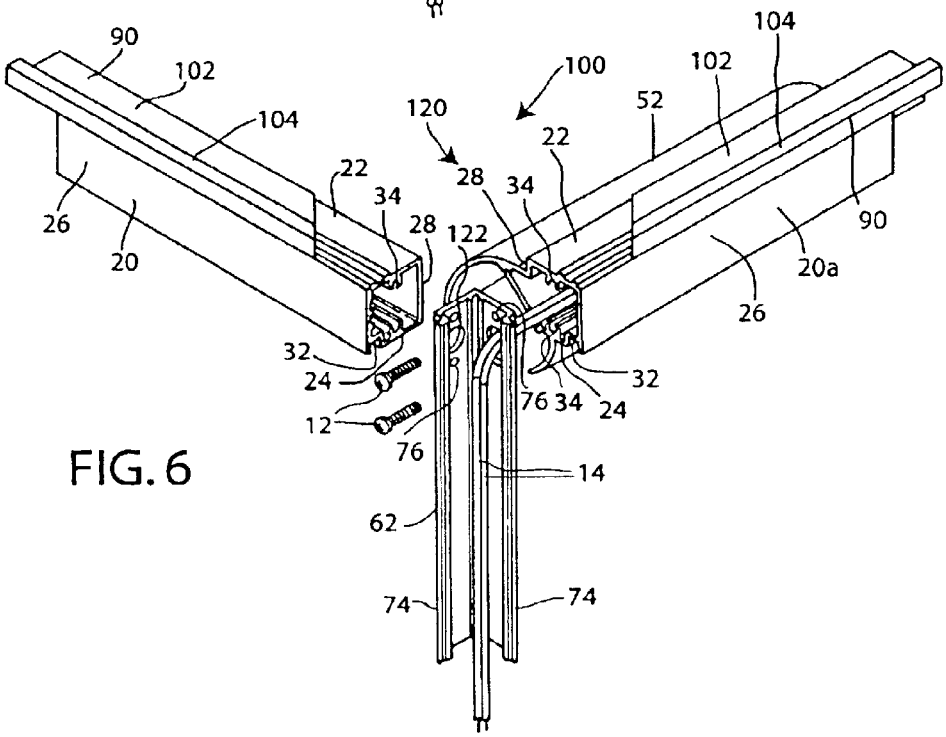
Figure 7:
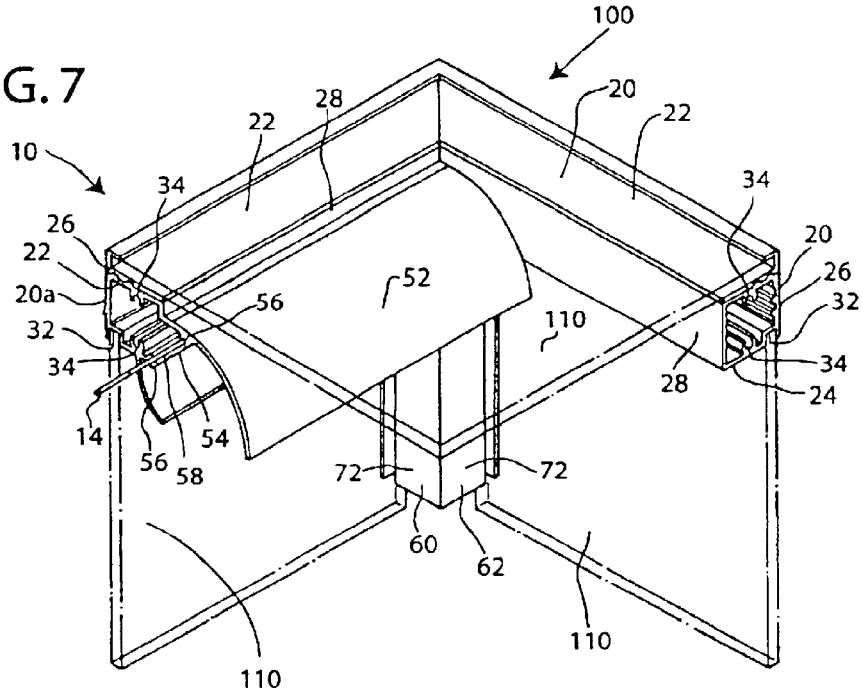
FIG. 7 is a perspective view of the assembled closed frame and breakable frame tubes with panels fitted into place as in FIG. 3, but showing the lighting fixture slat mounting gap.
Figure 8:
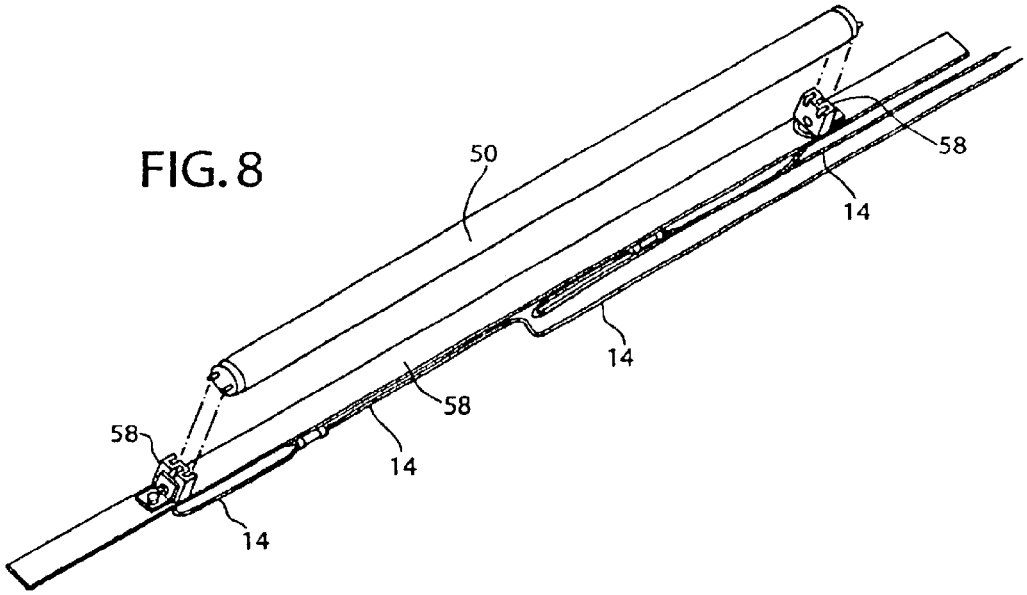
FIG. 8 is a perspective, exploded view of the preferred lighting fixture for fitting into the gap shown in FIG. 7.
Figure 9:
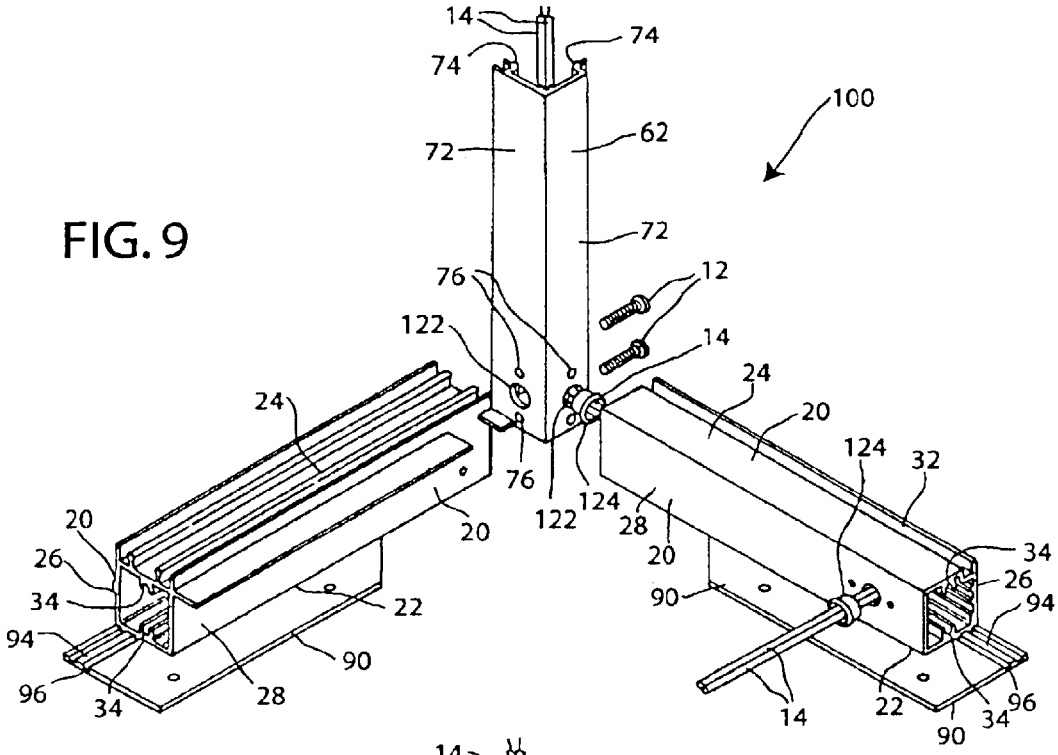
FIG. 9 is a view as in FIG. 1, except that the closed frame tubes are inverted and positioned for fastening to the bottom end of the breakable frame tube, and showing wiring extending down the breakable frame tube into one of the closed frame tubes and exiting through a hole and grommet in the second side wall of a closed frame tube. The closed frame tube at the left includes a sliding door lower track along its upper rearward edge.
Figure 10:
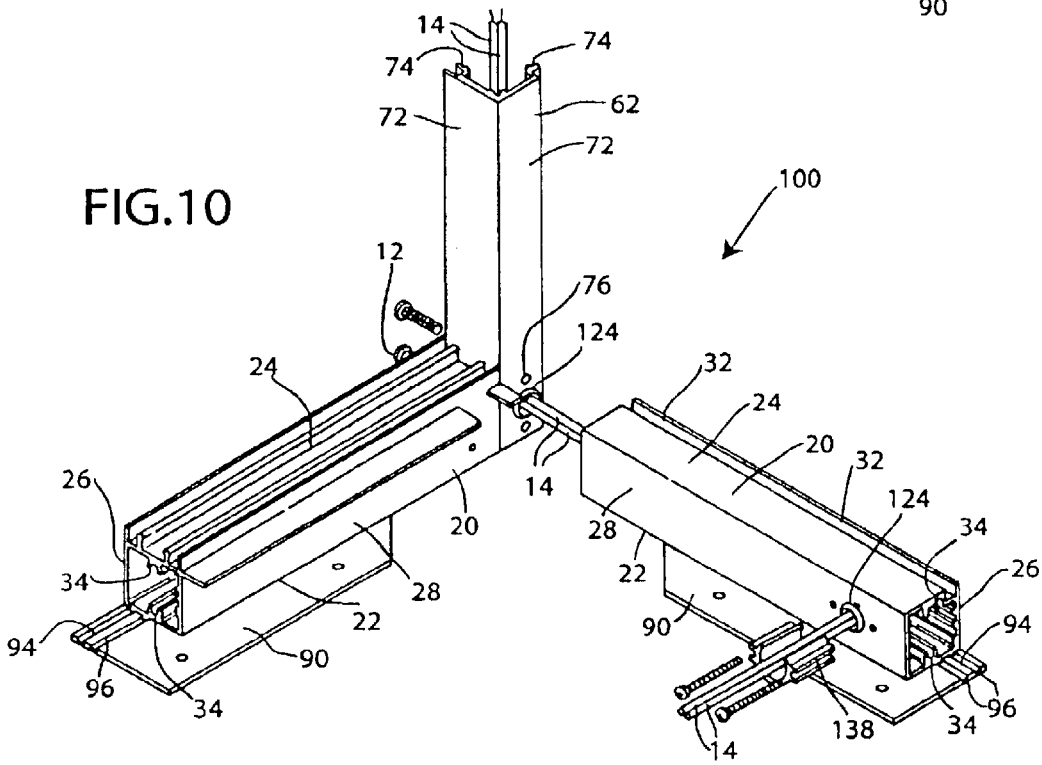
FIG. 10 is a view as in FIG. 9 with one of the closed frame tubes fastened to the breakable frame tube. A flex tube connector is added about the wiring protruding from the closed frame tube at the right.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figures 23, 23A, 23B, 24, 24A, 24B:
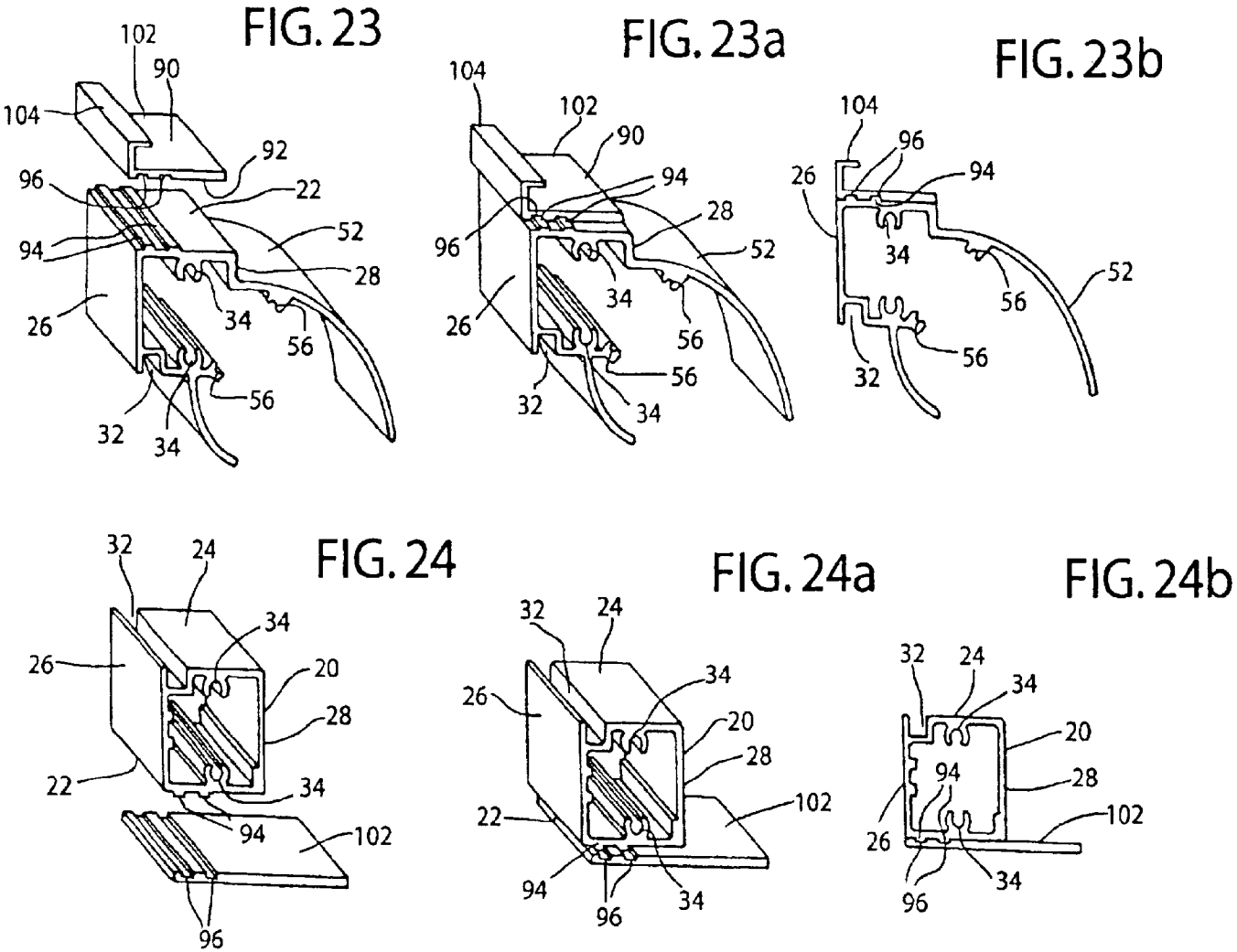
FIGS. 23–23*b* are progressive, perspective end views of a closed frame tube with an arched reflector plate and with longitudinal tongue elements and a panel engaging profile slat with longitudinal groove elements, showing the progression of the tongue elements engaging the groove elements.
FIGS. 24–24*b* are progressive, perspective end views of closed a frame tube with longitudinal tongue elements and a slat with longitudinal groove elements, showing the progression of the tongue elements engaging the groove elements.
Figure 26:
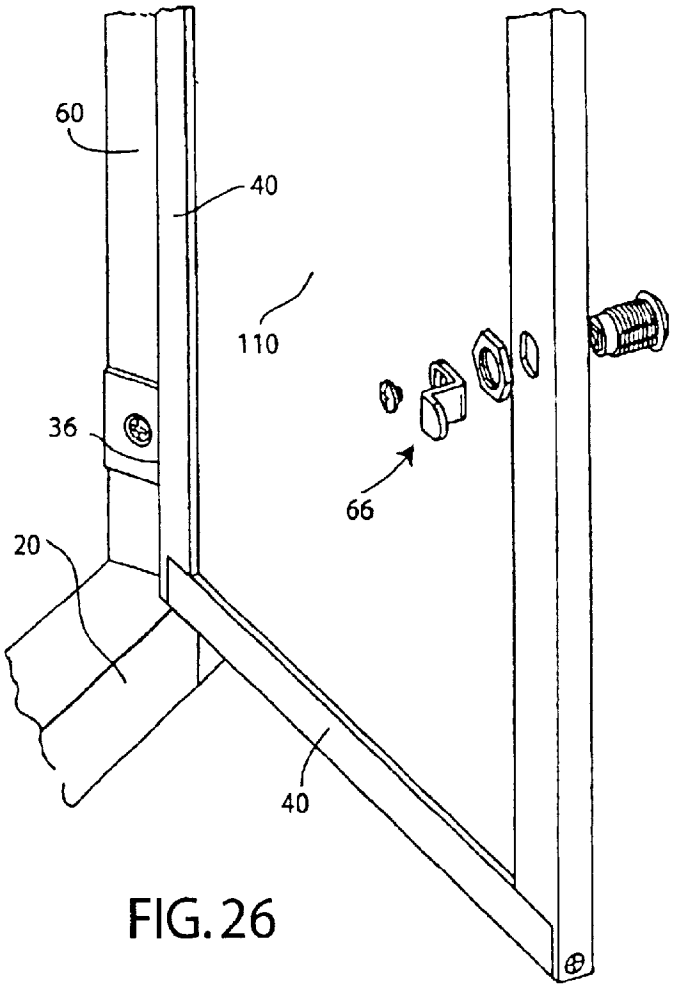
FIG. 26 is a perspective view of a door formed of a frame of panel mounting channels retaining a panel, the being door mounted to a breakable frame tube with a piano hinge. A door lock is shown in exploded form.
Figure 25:
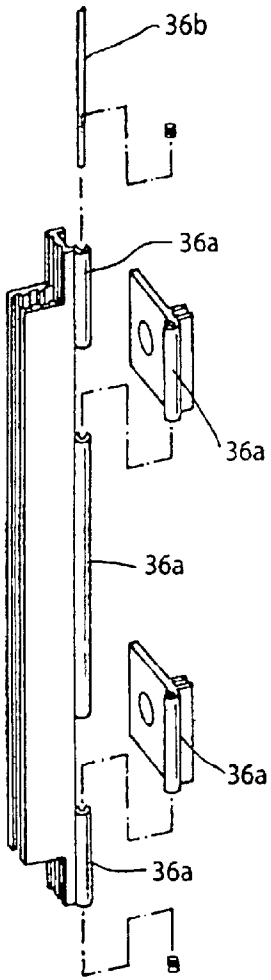
FIG. 25 is a perspective side view of a panel mounting channel fitted with a piano hinge shown in exploded form, with piano hinge tube elements separated from the piano hinge pin.
Figure 27:
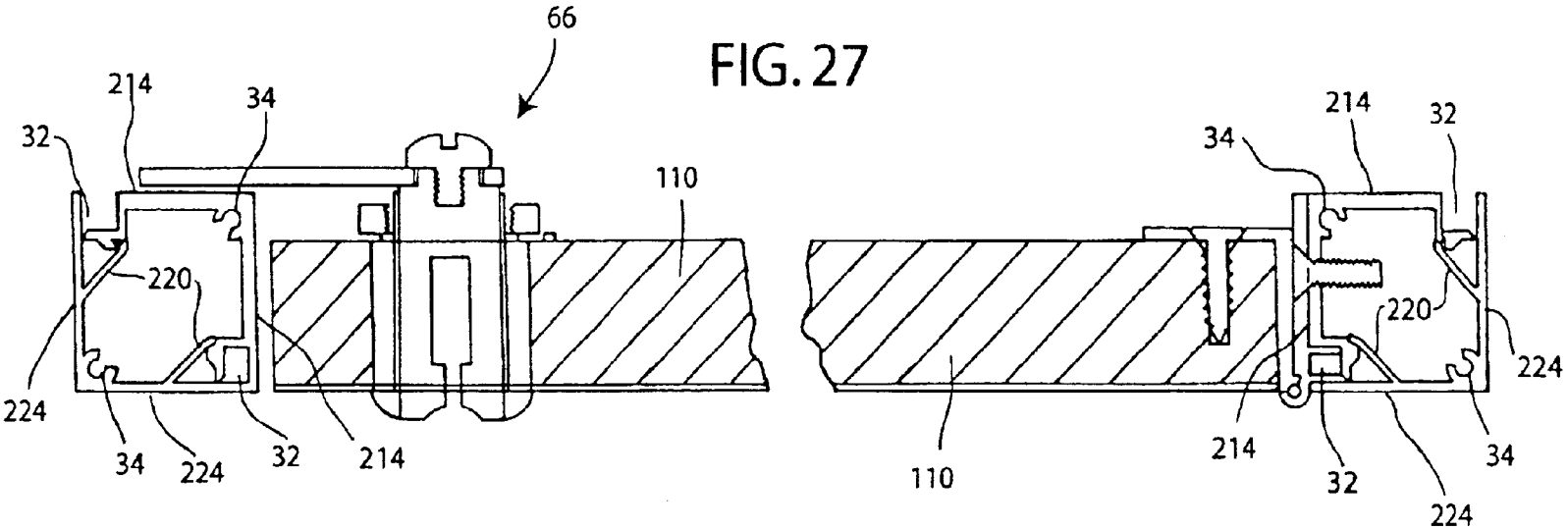
FIG. 27 is a cross-sectional end view of a door fitted with a wood panel, showing the preferred insertion direction of a wood screw into the door panel face relative to the wood grain for maximum strength, securing the door panel to an L-bracket, the door panel including a door lock. The door L-bracket is mounted with a piano hinge to a breakable frame member.
Figure 28:
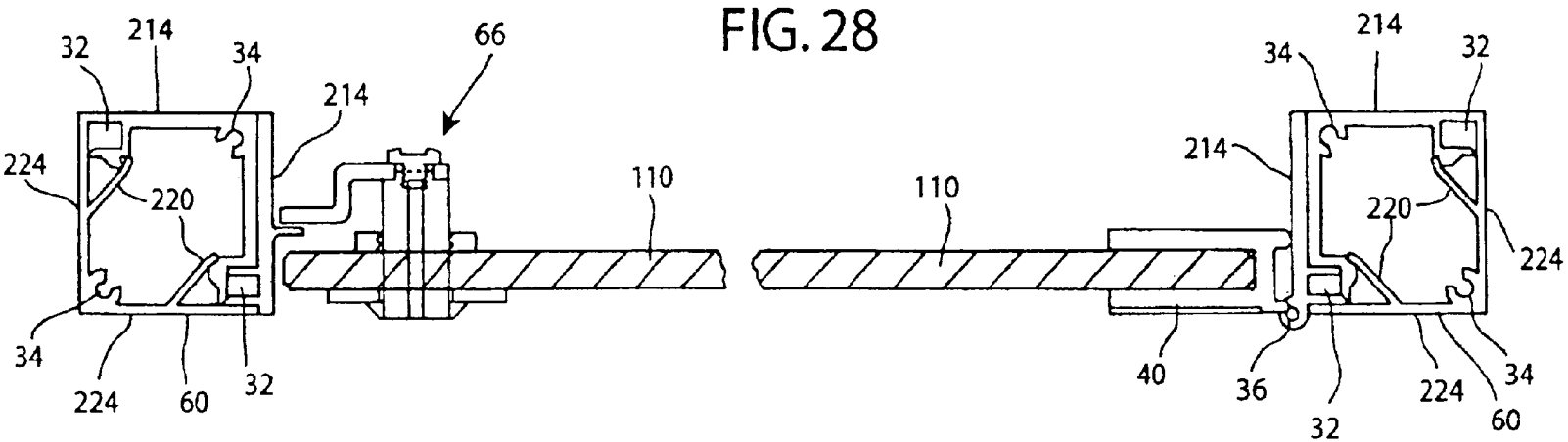
FIG. 28 is a view as in FIG. 27, but showing a narrower panel mounted using a panel mounting channel rather than an L-bracket.

Referring to FIGS. 1–28, a display case assembly system 10 is disclosed including extruded closed frame tubes 20 and extruded laterally breakable frame tubes 60 which interconnect to form a display case frame 100 and between which opaque and transparent display case panels 110 are fitted and retained, the breakable frame tube 60 opening for insertion of and closing for concealment of frame fasteners 12 and electric wiring 14. The breakable frame tubes 60 each include a mounting section 62 through which fasteners 12 are passed into laterally ends of laterally extending closed frame tubes 20 and a cover section 64 which snap engages laterally to the mounting section 62 to form a composite tube concealing the fasteners 12 and any fixture wiring 14. A panel engaging profile slat 90 is secured to a longitudinal slat mounting face 92 of each closed frame tube 20 with a profile slat engaging structure, and has the dual function of retaining a display case panel 110 and of extending across and blocking longitudinal sliding movement of adjacent cover sections 64 relative to their mounting sections 62, the profile slat engaging structure preferably taking the form of longitudinal tongue elements 94 which slide engagingly into longitudinal groove elements 96 provided on a face of each profile slat 90. See also FIGS. 23–24*b*. Each panel engaging profile slat 90 preferably includes longitudinal slat mounting face 92, and an opposing slat panel engaging face 102 including a slat engaging channel 104. Closed frame tubes 20 are all typically oriented horizontally, and breakable frame tubes 60 are all typically oriented vertically, although exceptions to this rule are fully contemplated.

Where a display case lighting fixture 120 is provided, wiring 14 is fitted longitudinally through a closed frame tube 20, preferably though not necessarily prior to frame 100 assembly, and through a wiring port 122 in a breakable frame tube mounting section 62 fastened to an end of the closed frame tube 20, and along the mounting section 62 either to enter another closed frame tube 20 or to exit the case frame 100 through a flexible hose 126 from an exit port (not shown) in the breakable frame tube 60 or in a closed frame tube 20. The wiring ports 122 each preferably are fitted and lined with a plastic wire passing grommet 124 to protect wiring 14 insulation from damaging abrasion.

Each closed frame tube 20 preferably takes the form of a tube of substantially square cross-section which is extruded, such as from aluminum, preferably anodized, having a tube slat engaging wall 22, a tube panel engaging wall 24, and first and second tube side walls 26 and 28, respectively. Extending longitudinally and centrally along the inward face of the tube slat engaging wall 22, and also along the inward face of the tube panel engaging wall 24, is a channel-shaped fastener receiving bead 34 which is tapped at each end for receiving at each end a threaded fastener 12 passing through a breakable frame tube mounting section 62 and therefore connecting the breakable frame tube 60 to a closed frame tube 20. See FIGS. 1 and 2. The outward face of the tube slat engaging wall 22 includes the profile slat engaging structure. In the tube panel engaging wall 24, adjacent the first tube side wall 26, is an inward jog defining a panel receiving channel 32.

Where hinged display case doors are desired, a square, U-shaped panel mounting channel 40 is provided with a piano hinge 36 secured along its length, and the hinge 36 is connected longitudinally to the first tube side wall 26 so that the panel mounting channel 40 pivots on piano hinge 36 relative to the closed frame tube 20. A piano hinge 36 is preferred, made up of piano hinge tube portions 36*a* interlinked with a piano hinge pin 36*b*. See FIGS. 25–28. A door lock assembly 66 is preferably provided in each door. A panel 110, either of opaque board, glass, plexiglass or other material, is fitted into the panel mounting channel 40, and additional lengths of panel mounting channel 40 are fitted around the perimeter of the panel 110 to form a complete door frame, preferably having mitered corners.

A lighting fixture mounting closed frame tube 20*a* preferably is provided with an integral, downwardly arched reflector plate 52 protruding outwardly from the tube second side wall 28, immediately adjacent to the tube slat engaging wall 22. A fixture plate receiving gap 54 is provided between the second tube side wall 28 and the tube panel engaging wall 24, the second tube side wall 28 and the tube panel engaging wall 24 having opposing fixture plate grooves 56, and a fixture plate 58 with a fluorescent bulb fixture 50 mounted to a first fixture plate 58 face is slid simultaneously into the opposing fixture plate grooves 56 to fill the fixture receiving gap 54, and is oriented so that the fixture 50 protrudes outwardly underneath the reflector plate 52.

The mounting section 62 of each breakable frame tube 60 preferably has an L-shaped cross-section forming two perpendicular mounting walls 72, each mounting wall 72 having a connected edge integral with a connected edge of the other mounting wall 72 and having a free edge shaped to form a grooved snap engagement structure 74. Near each longitudinal end of each mounting wall 72 a wiring port 122 is provided, and on either longitudinal side of the wiring port 122 is a fastener passing port 76 spaced so that both fastener passing ports 76 simultaneously correspond to and register with open ends of fastener receiving beads 34 of a closed frame tube 20. Each cover section 64 preferably has an L-shaped cross-section as well, forming two perpendicular cover walls 82, each cover wall 82 having a connected edge integral with a connected edge of the other cover wall 82 and having a free edge shaped to form a tongue bead 84 of outwardly tapering and barbed cross-section sized and spaced from the opposing tongue bead 84 to simultaneously enter and engage the two grooved snap engagement structures 74 of a mounting section 62, so that the cover section 64 can be snapped manually and engagingly into the snap engagement structures 74.

Figure 11:
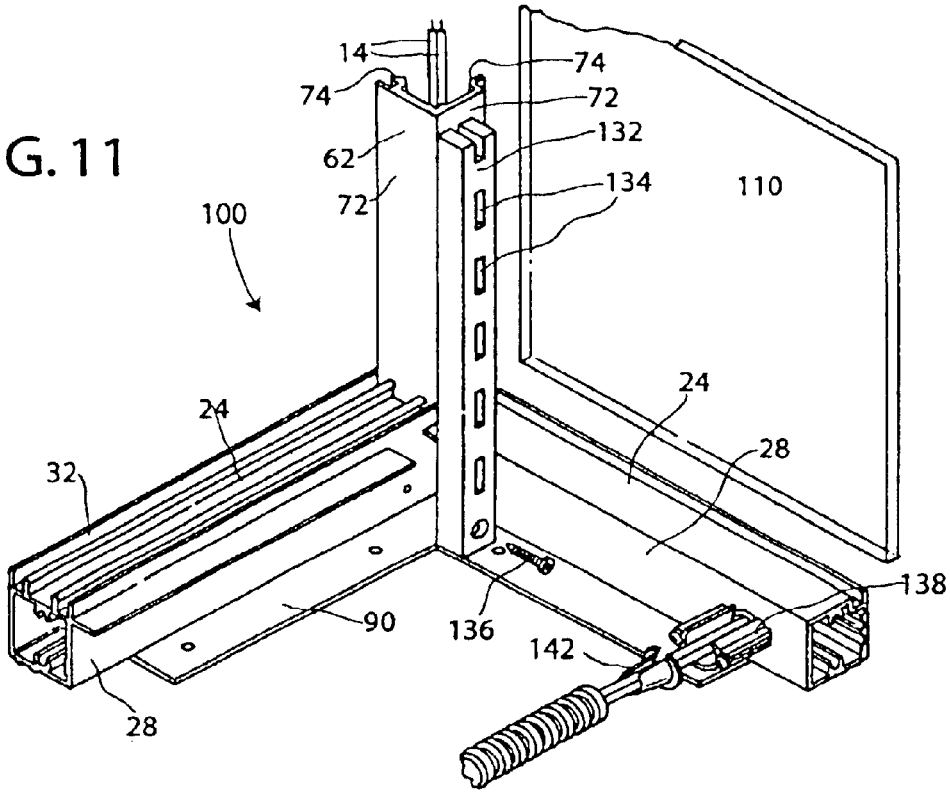
FIG. 11 is a view as in FIG. 10 with both closed frame tubes fastened to the breakable frame tube and a standard secured and a panel positioned to be secured to the partial display case frame. An anti-short bushing is added about the wiring protruding from the closed frame tube at the right, beyond the flex tube connector.
Figure 12:
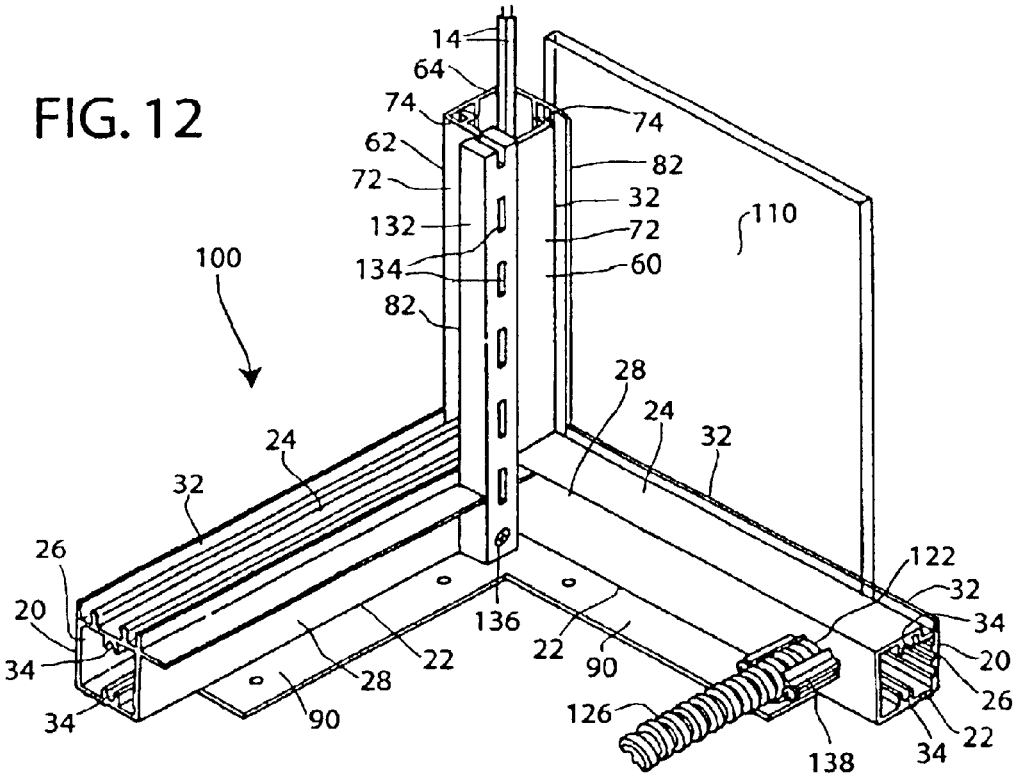
FIG. 12 is a view as in FIG. 11 with both closed frame tubes fastened to the breakable frame tube and the panel fitted into intersecting panel receiving channels.
Figure 13:
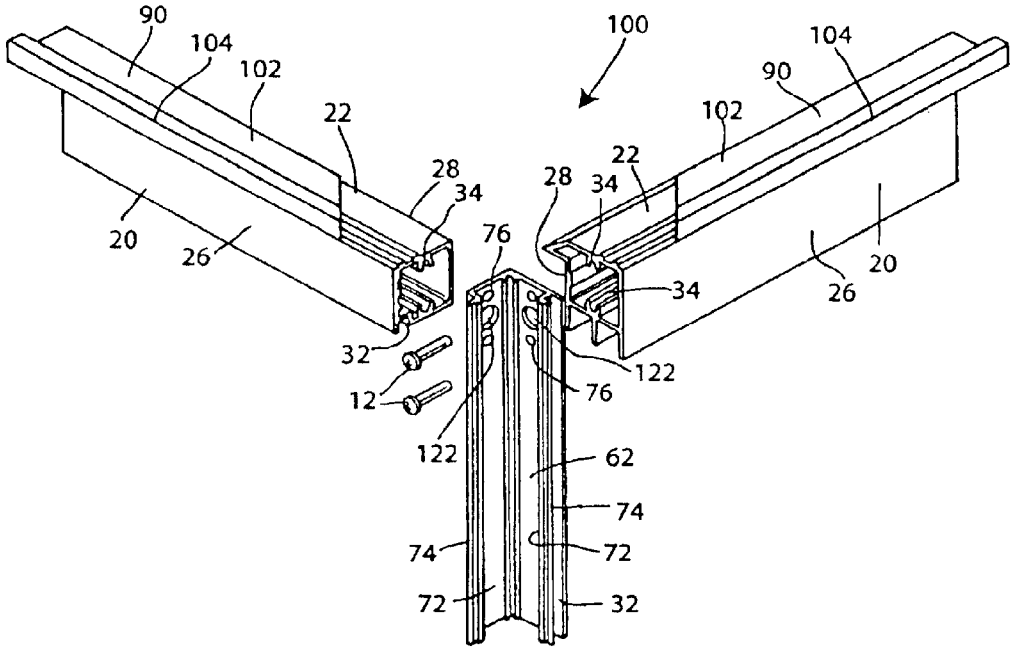
FIG. 13 is a view as in FIG. 1, but with a basic closed frame tube replaced with a double panel receiving channel closed frame tube for receiving sliding display case panels, which can slide one behind the other to function as display case access doors. Two adjacent sliding door upper tracks are shown on the lower face of the close frame tube at the right.
Figure 14:
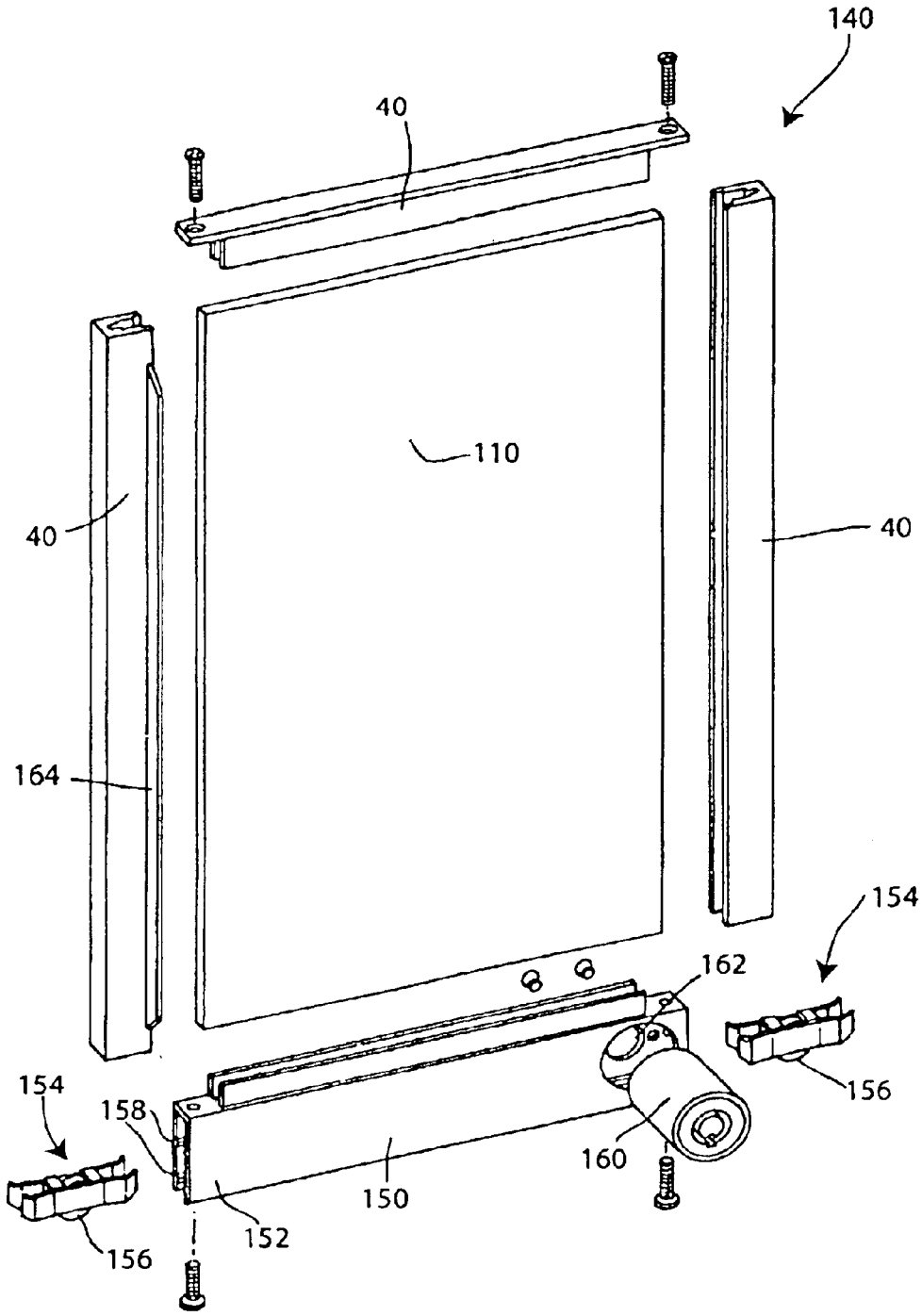
FIG. 14 is a perspective, exploded view of a sliding panel door with a sliding door shoe channel and plunger lock.
Figure 15:
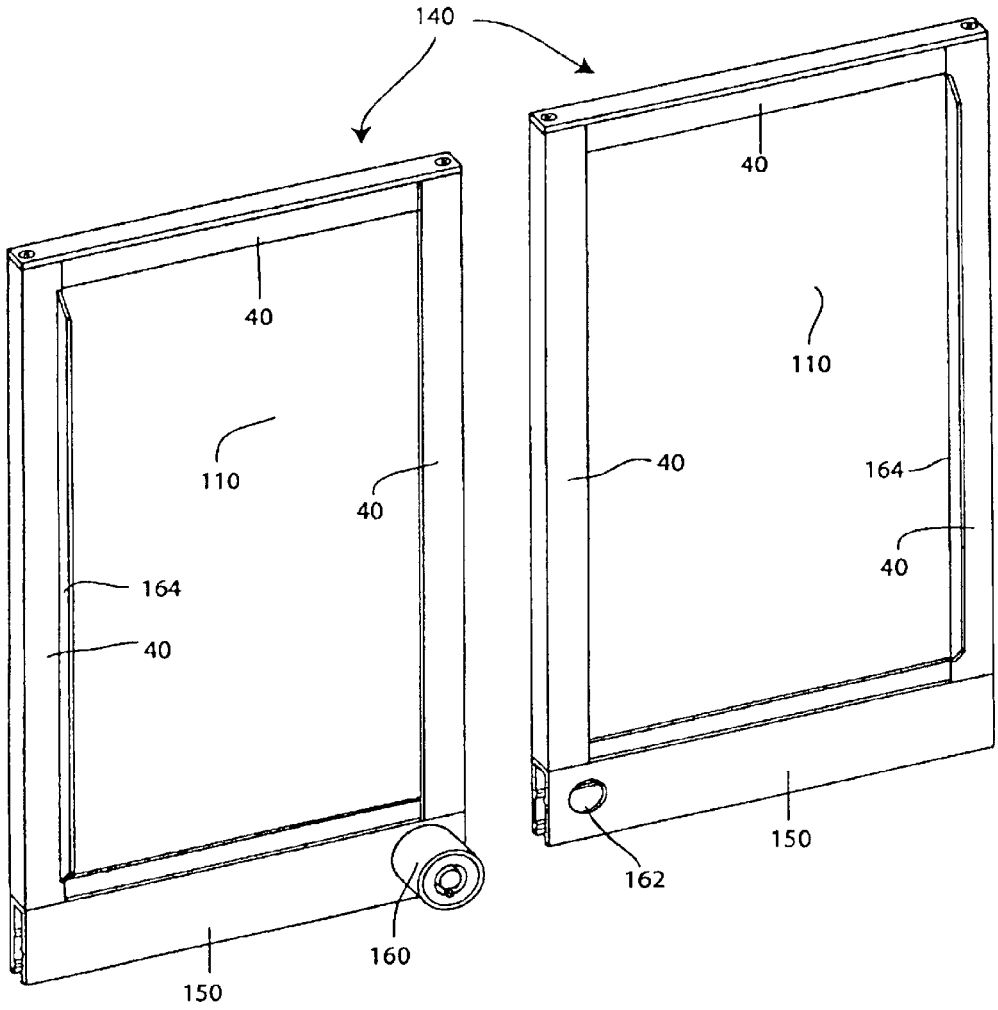
FIG. 15 is a view of the sliding panel of FIG. 14 after assembly and fitting with the plunger lock, and of a second sliding panel with the plunger lock omitted.
Figure 16:
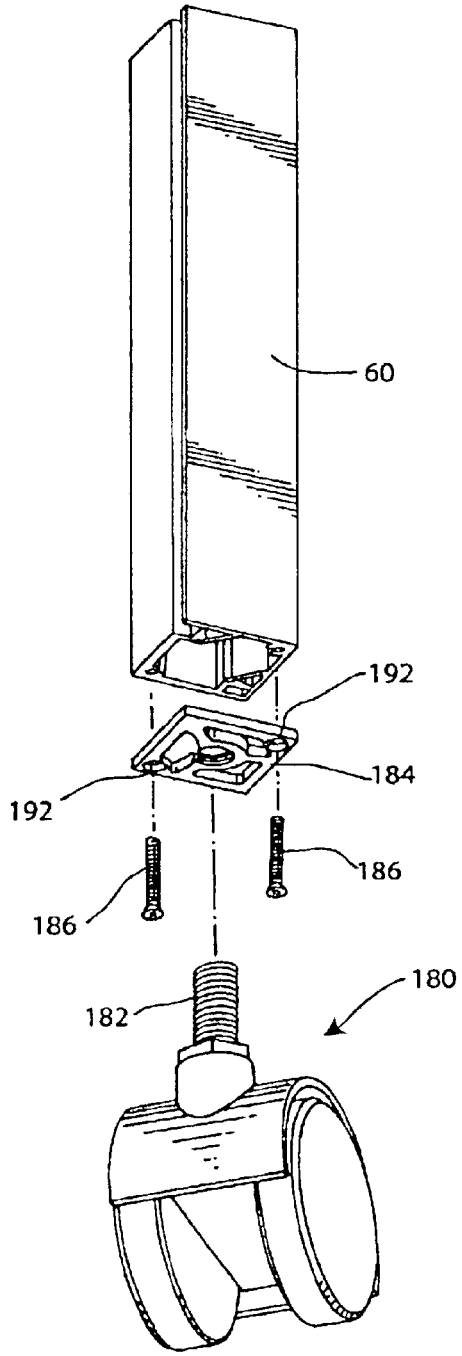
FIG. 16 is a perspective exploded view of a display case caster wheel assembly positioned for fitting to the lower end of an upright or vertically oriented closed frame tube.
Figure 17:
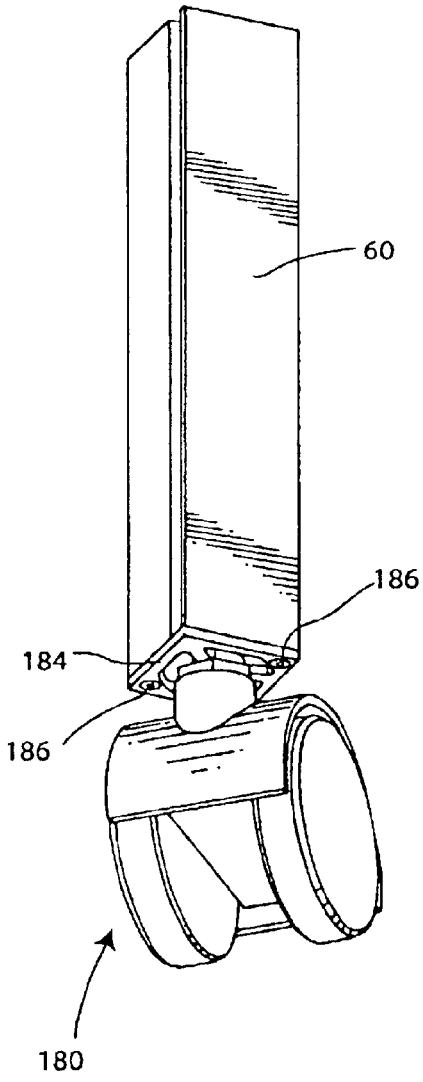
FIG. 17 is a view as in FIG. 16, with the caster wheel assembly and closed frame tube fully assembled.
Figures 18, 18A, 18B, 19, 19A, 19B, 20, 20A, 20B:
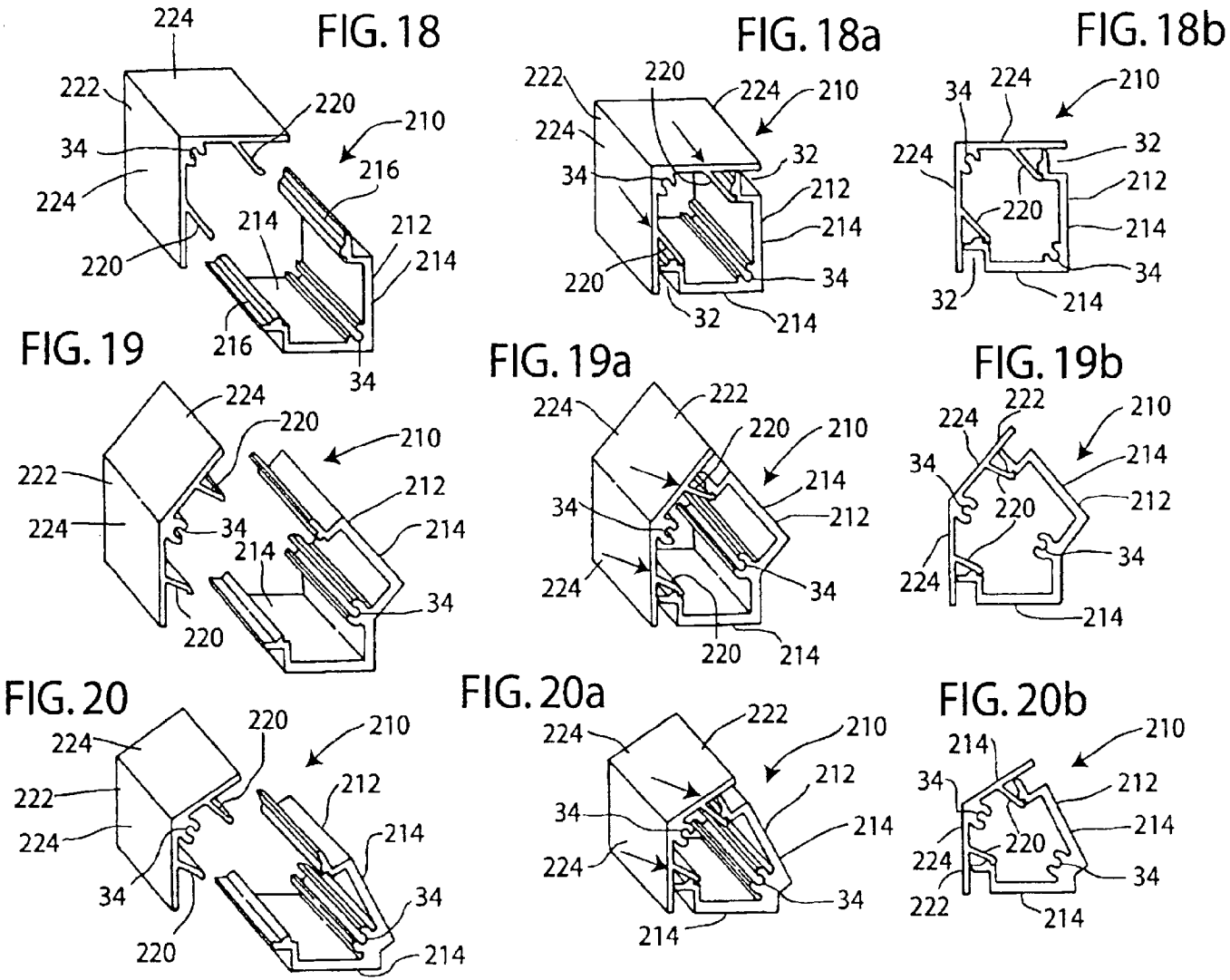
FIGS. 18–18*b* are perspective end views of ninety degree alternative breakable frame members with cover section engaging tabs progressing to assembly.
FIGS. 19–19*b* are perspective end views of one hundred thirty five degree alternative breakable frame members with cover section engaging tabs progressing to assembly.
FIGS. 20–20*b* are perspective end views of one hundred twenty degree alternative breakable frame members with cover section engaging tabs progressing to assembly.
Figures 21, 21A, 21B, 22, 22A, 22B:
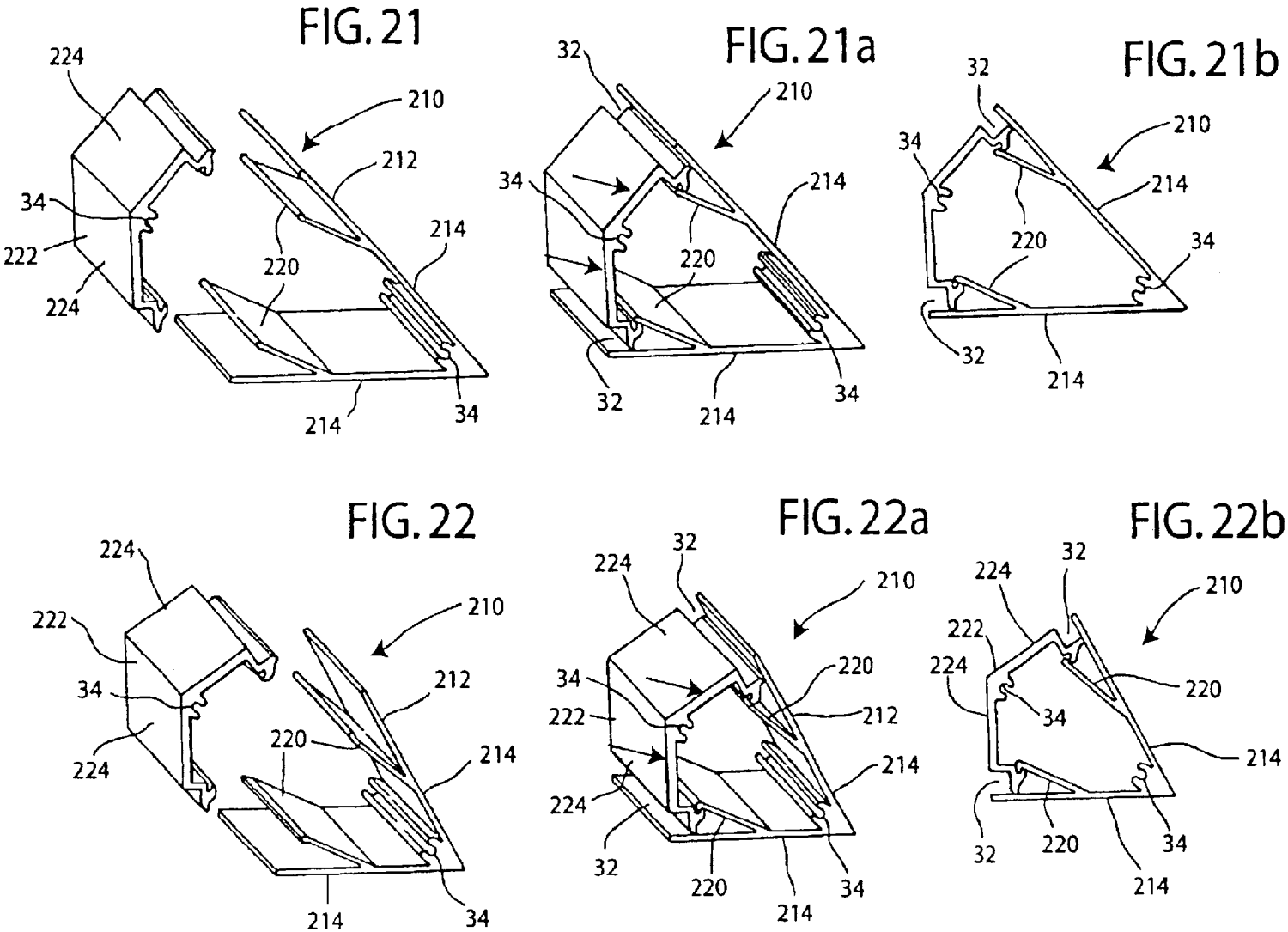
FIGS. 21–21*b* are perspective end views of forty-five degree alternative breakable frame members with mounting section engaging tabs progressing to assembly.
FIGS. 22–22*b* are perspective end views of sixty degree alternative breakable frame members with mounting section engaging tabs progressing to assembly.

As shown in FIGS. 11–12, conventional standards 132 for shelves are optionally provided. Each standard 132 includes a vertically elongate member having a longitudinal series of slots 134 which is fastened to breakable frame tubes 60 with standard screws 136 for mounting shelves (not shown) within the assembly display case. A flex hose connector 138 and an anti-short busing 142 are shown about the wiring 14. Sliding panel doors 140 optionally are provided, as shown in FIGS. 14 and 15, which each include a preferably rectangular glass or opaque panel 110 having segments of square U-shaped panel mounting channels 40 fitted over top and side panel 110 edges. A sliding door shoe channel 150 is provided over and along the panel 110 lower edge, additionally having an opposing downwardly opening wheel channel 152, a wheel assembly 154 including a door wheel 156 being fitted into and retained by wheel channel longitudinal ribs 158 within the wheel channel 152, so that a portion of door wheel 156 protrudes downwardly out of wheel channel 152. A plunger lock 160 optionally is inserted into and retained within a plunger lock port 162 opening into a side of wheel channel 152. A door gripping tab 164 preferably protrudes from one of the vertical panel mounting channel 40 segments.

A conventional display case caster wheel assembly 180 having an upwardly protruding and threaded mounting shaft 182 optionally is provided at the lower end of each breakable frame tube 60 so that the assembled display case can be rolled over a store floor. See FIGS. 16–17. A wheel assembly mounting plate 184 is fastened to the breakable frame tube 60 lower end with screws 186 fitted through fastener ports 192 in the wheel assembly mounting plate 184. A threaded mounting shaft port 194 is provided in mounting plate 184 into which mounting shaft 182 is engagingly screwed.

A variety of alternative breakable frame member 210 shapes are provided for forming display cases having mounting sections 212 with mounting walls 214 oriented at any of various angles relative to each other to retain and orient panels 110 to produce display cases having numbers of sides other than four and circumferential shapes other than rectangular. Preferred mounting wall 214 angles relative to each other include but are not limited to 90 degrees, 135 degrees and 120, as shown in FIGS. 18–18*b*, 19–19*b* and 20–20*b*, respectively, having mounting section inner engaging tabs 220, and 45 degrees and 60 degrees, as shown in FIGS. 21–21*b* and 22–22*b*, respectively, having cover section inner engaging tabs 220. To produce these configurations, each mounting wall 214 has a connected edge integral with a connected edge of the other mounting wall 214 and has a free edge and longitudinally elongate inner engaging tabs 220 branching inwardly from either mounting walls 214 or cover walls 224, with tab free edges each shaped to form a grooved snap engagement structure 216. Near each longitudinal end of each mounting wall 214 a wiring port 122 is provided, and on either longitudinal side of the wiring port 122 is a fastener passing port 76 spaced so that both fastener passing ports 76 simultaneously correspond to and register with open ends of fastener receiving beads 34 of a closed frame tube 20. Cover sections 222 are also provided and each preferably has an expanded or widened and obtuse L-shaped cross-section as well, forming two perpendicular cover walls 224. Each inner engaging tab 220 has a connected edge having a free edge shaped to form a tongue bead 226 of outwardly tapering and barbed cross-section sized and spaced from the opposing tongue bead 226 to simultaneously enter and engage the two grooved snap engagement structures 216 of a mounting section 212, so that the cover section 222 can be snapped manually and engagingly into a mounting section 212.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A display case assembly system, comprising:

a plurality of closed frame tubes, each said closed frame tube comprising two closed frame tube longitudinal ends, at least one said closed frame tube longitudinal end comprising fastener receiving means;

a plurality of laterally breakable frame tubes, each said breakable frame tube comprising a breakable frame tube mounting section having a fastener port;

at least one fastener fitted through said fastener port in one of said mounting section and into one of said fastener receiving means in one of said closed frame tube longitudinal ends, such that at least one said breakable frame tube is fastened to one said closed frame tube longitudinal end;

a breakable frame tube cover section with snap engagement means for snap engagement with said mounting section to form a composite tube concealing said at least one fastener;

a panel mounted and extending between said closed frame tube and said breakable frame tube;

a wiring port in at least one said breakable frame tube mounting section and additionally comprising a display case lighting fixture and lighting fixture wiring fitted longitudinally through said closed frame tube and through said wiring port.

2. The display case assembly system of claim 1, wherein said panel is one of an opaque panel and a translucent panel.

3. The display case assembly system of claim 1, wherein said wiring port is fitted and lined with a wire passing grommet.

4. The display case assembly system of claim 1, each said closed frame tube comprising:

a tube of one of: substantially square cross-section and substantially rectangular cross-section and having a tube slat engaging wall, a tube panel engaging wall, and first and second tube side walls.

5. The display case assembly system of claim 4, wherein a plurality of said closed frame tubes are formed of extruded aluminum.

6. The display case assembly system of claim 4, wherein said slat engaging wall has an inward face and wherein a channel-shaped fastener engaging bead extends longitudinally along the inward face of said tube slat engaging wall and along an inward face of said tube panel engaging wall, said channel-shaped fastener receiving bead being tapped at each end for receiving at each end a threaded fastener passing through said breakable frame tube mounting section and connecting said breakable frame tube to said closed frame tube.

7. The display case assembly system of claim 6, wherein said mounting sections each comprise two mounting walls having intersecting and integral mounting wall connected edges, each said mounting wall having a cover wall free edge shaped to form a mounting section snap engagement structure.

8. The display case assembly system of claim 7, wherein said cover section comprises two cover walls having intersecting and integral cover wall connected edges, each said cover wall having a cover wall free edge shaped to form a cover section snap engagement structure configured to snap engage one of said mounting section snap engagement structures, such that said cover section can be snapped engagingly to one said mounting section.

9. The display case assembly system of claim 7, additionally comprising a wiring port adjacent to each mounting wall longitudinal end.

10. The display case assembly system of claim 7, additionally comprising a fastener passing port adjacent to each mounting wall longitudinal end and being positioned to correspond and register with an open end of one of said fastener receiving beads of one of said closed frame tubes.

11. The display case assembly system of claim 4, wherein an outward face of said tube slat engaging wall comprises a profile slat engaging structure.

12. The display case assembly system of claim 4, wherein said tube panel engaging wall comprises an inward jog defining a panel receiving channel.

13. The display case assembly system of claim 4, additionally comprising a hinged door panel, said hinged door panel comprising:

a panel mounting channel with a hinge secured longitudinally along said panel mounting channel, and said hinge being connected longitudinally to said first tube side wall of a respective closed frame tube such that said panel mounting channel pivots on said hinge relative to said closed frame tube;

and a panel fitted into said panel mounting channel.

14. The display case assembly system of claim 13, wherein said panel has a panel perimeter, additionally comprising additional lengths of panel mounting channel fitted around said panel perimeter to define a panel frame.

15. A display case assembly system, comprising:

a plurality of closed frame tubes, each said closed frame tube comprising two closed frame tube longitudinal ends, at least one said closed frame tube longitudinal end comprising fastener receiving means;

a plurality of laterally breakable frame tubes, each said breakable frame tube comprising a breakable frame tube mounting section having a fastener port;

at least one fastener fitted through said fastener port in one of said mounting section and into one of said fastener receiving means in one of said closed frame tube longitudinal ends, such that at least one said breakable frame tube is fastened to one said closed frame tube longitudinal end;

a breakable frame tube cover section with snap engagement means for snap engagement with said mounting section to form a composite tube concealing said at least one fastener;

and a panel mounted and extending between said closed frame tube and said breakable frame tube;

wherein each said closed frame tube has a longitudinal slat mounting face, additionally comprising a panel engaging profile slat secured to one said longitudinal slat mounting face for mounting and retaining a display case panel and for extending across and blocking longitudinal sliding movement of an adjacent said cover section relative to an adjacent said mounting section.

16. The display case assembly system of claim 15, wherein said longitudinal slat mounting face of said closed frame tube comprises a profile slat engaging structure.

17. The display case assembly system of claim 16, wherein said profile slat engaging structure comprises a longitudinal tongue element and wherein said profile slat comprises a longitudinal groove element sized such that said longitudinal tongue element slides engagingly into said longitudinal groove element.

18. A display case assembly system, comprising:

a plurality of closed frame tubes, each said closed frame tube comprising two closed frame tube longitudinal ends, at least one said closed frame tube longitudinal end comprising fastener receiving means;

a plurality of laterally breakable frame tubes, each said breakable frame tube comprising a breakable frame tube mounting section having a fastener port;

at least one fastener fitted through said fastener port in one of said mounting section and into one of said fastener receiving means in one of said closed frame tube longitudinal ends, such that at least one said breakable frame tube is fastened to one said closed frame tube longitudinal end;

a breakable frame tube cover section with snap engagement means for snap engagement with said mounting section to form a composite tube concealing said at least one fastener;

and a panel mounted and extending between said closed frame tube and said breakable frame tube;

wherein said closed frame tube additionally compromises a tube of one of: substantially square cross-section and substantially rectangular cross-section and having a tube slat engaging wall, a tube panel engaging wall, and first and second tube side walls and a downwardly arched reflector plate protruding outwardly from said tube second side wall adjacent to said slat engaging wall; a fixture slat receiving gap between said second tube side wall and said tube panel engaging wall, said second tube side wall and said tube panel engaging wall having opposing fixture slat engaging means, and fixture slat with a first fixture slat face and a lighting fixture mounted to said first fixture slat face and engaged by said fixture slat engaging means, extending across said fixture receiving gap and oriented such that said lighting fixture protrudes underneath said reflector plate.

19. The display case assembly system of claim 18, wherein said lighting fixture is a fluorescent bulb fixture.

* * * * *